US008746760B2

(12) United States Patent
Chen et al.

(10) Patent No.: US 8,746,760 B2
(45) Date of Patent: Jun. 10, 2014

(54) HANDLE-RETURNING DEVICE FOR A CYLINDER LOCK ASSEMBLY

(75) Inventors: Po-Yang Chen, Chiayi (TW); Kai-Ting Tung, Chiayi (TW); Yu-Ting Huang, Chiayi (TW); Chia-Min Sun, Chiayi (TW); Song-Gen Shyu, Chiayi County (TW); Ching-Chuan Kuo, Chiayi County (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 108 days.

(21) Appl. No.: 13/421,279

(22) Filed: Mar. 15, 2012

(65) Prior Publication Data

US 2012/0235429 A1 Sep. 20, 2012

(30) Foreign Application Priority Data

Mar. 16, 2011 (TW) ..... 100204706 U

(51) Int. Cl.
*E05B 15/02* (2006.01)
*E05B 3/00* (2006.01)

(52) U.S. Cl.
USPC . 292/357; 292/336.3; 292/347; 292/DIG. 53; 292/348; 70/224; 70/451

(58) Field of Classification Search
USPC ..... 292/336.3, 336.5, 347, 348–359, 292/DIG. 52, DIG. 53, DIG. 54, DIG. 60, 292/DIG. 64; 70/224, 450–452
See application file for complete search history.

(56) References Cited

U.S. PATENT DOCUMENTS

| | | | | |
|---|---|---|---|---|
| 5,265,924 | A * | 11/1993 | Kim | 292/336.3 |
| 5,562,317 | A * | 10/1996 | Kuo et al. | 292/359 |
| 5,666,833 | A | 9/1997 | Gao et al. | |
| 6,101,856 | A * | 8/2000 | Pelletier et al. | 70/472 |
| 6,575,006 | B1 * | 6/2003 | Don | 70/472 |
| 6,880,872 | B2 * | 4/2005 | Eller et al. | 292/357 |
| 7,073,829 | B2 | 7/2006 | Kuo et al. | |
| 7,137,657 | B2 | 11/2006 | Wu et al. | |
| 7,178,373 | B2 * | 2/2007 | Shen et al. | 70/224 |
| 2009/0211318 | A1 * | 8/2009 | Pilotelli | 70/141 |
| 2011/0006550 | A1 * | 1/2011 | Cho | 292/167 |

* cited by examiner

*Primary Examiner* — Carlos Lugo
*Assistant Examiner* — Alyson M Merlino
(74) *Attorney, Agent, or Firm* — Hamre, Schumann, Mueller & Larson, P.C.

(57) ABSTRACT

In a handle-returning device of a cylinder lock assembly, a support base has an inner annular flange and an axial spring-retaining lug. A rotation driver has an inner tubular wall extending into the inner annular flange of the support base, and a spring driving element. A torsion spring is disposed around the inner annular flange and between the support base and the rotation driver, and has a spring leg abutting the spring-retaining lug and the spring driving element. A rotary plate abuts the support base opposite to the rotation driver, and has an engaging part engaging a tongue projecting from the rotation driver. A reinforced structure is thus provided to oppose high torsional stresses produced upon rotation of a lever handle.

10 Claims, 6 Drawing Sheets

HANDLE-RETURNING DEVICE FOR A CYLINDER LOCK ASSEMBLY

CROSS-REFERENCE TO RELATED APPLICATION

This application claims priority of Taiwanese Patent Application No. 100204706 filed on Mar. 16, 2011.

BACKGROUND OF THE INVENTION

1. Field of the Invention

The invention relates to a cylinder lock assembly, and more particularly to a handle-returning device, which can rotate along with a tubular spindle of a cylinder lock assembly when a handle is rotated, and which can return the handle to an original rest position.

2. Description of the Related Art

Cylinder locks typically include a latch operator to operate a latch, a tubular spindle connected to an operating lever handle or knob to actuate a latch operator, and a handle-returning device that is rotatable along with the tubular spindle and that includes a torsion spring to return the operating lever handle or knob to an original rest position thereof. When the operating lever handle or knob is rotated, the tubular spindle operates the latch operator to retract the latch, and at the same time rotates the handle-returning device. When the operating lever handle or knob is released, the torsion spring of the handle-returning device returns the operating lever handle or knob to the original rest position.

Generally, the handle-returning device has a rotating member disposed around and in engagement with the tubular spindle for simultaneous rotation. Like the operating knob, the operating lever handle has a casing body surrounding the tubular spindle. Examples of cylinder lock assembles having lever handles are disclosed in U.S. Pat. Nos. 7,137,657, 5,666,833, 7,073,829. Because the operating lever is heavier than the operating knob and has an L-shaped configuration with a center of gravity usually eccentric to the axis of the tubular spindle, compared to the operating knob, the operating lever handle can impose a relatively high torsional stress on the tubular spindle and the handle-returning device. As a result, after a long time of use, the operating lever handle is prone to droop, and the torsional spring is liable to fatigue failure losing its capability to return the lever handle to its horizontal rest position. When a large force is applied to the lever handle, the tubular spindle can become twisted, or even break.

SUMMARY OF THE INVENTION

An object of the present invention is to provide a handle-returning device of the above-mentioned type, which is easy to construct and assemble and which has a reinforced structure sufficient to oppose high torsional stresses produced upon rotation of a lever handle after a long term use.

According to one aspect of the invention, a handle-returning device comprises: a support base having an annular base wall, an inner annular flange projecting axially from an inner periphery of the annular base wall and defining a central hole, and at least one spring-retaining lug projecting axially from the annular base wall; a rotation driver including an annular plate, an inner tubular wall extending axially from an inner periphery of the annular plate into the central hole of the support base, at least one spring driving element formed on the annular plate and aligned radially with the spring-retaining lug, and at least one tongue projecting axially from the inner tubular wall and extending through the central hole of the support base; a torsion spring disposed around the inner annular flange and between the annular base wall and the annular plate, and having at least one spring leg abutting against the spring-retaining lug and the spring driving element; and a rotary plate disposed in abutment with a surface of the annular base wall of the support base opposite to the annular plate, and having an engaging part proximate to the central hole of the support base to engage the tongue of the rotation driver.

According to another aspect of the invention, a handle-returning device comprises: a support base having an annular base wall, an inner annular flange projecting axially from an inner periphery of the annular base wall, and at least one spring-retaining lug projecting axially from the annular base wall; a rotation driver including an annular plate, an inner tubular wall extending axially from an inner periphery of the annular plate into the inner annular flange of the support base, and at least one spring driving element extending axially from the outer periphery of the annular plate; a torsion spring disposed around the inner annular flange and between the annular base wall of the support base and the annular plate of the rotation drive, and having at least one spring leg abutting against the spring-retaining lug and the spring driving element; and a cover plate covering a surface of the annular plate of the rotation driver opposite to the annular base wall and having an interlocking part to engage the annular base wall.

According to still another aspect of the invention, a handle-returning device comprises a support base, a rotation driver, and a torsion spring. The support base has an annular base wall, an inner annular flange projecting axially from an inner periphery of the annular base wall and defining a central hole, and an outer annular flange projecting axially from an outer periphery of the annular base wall. The annular base wall is stepped and has a first annular section connected to the inner annular flange, a second annular section connected to the outer annular flange, a third annular section interconnecting and extending transversely of the first and second annular sections, and a pair of annularly spaced apart spring-retaining lugs projecting axially from the first annular section. The rotation driver includes an annular plate facing the first annular section, an inner tubular wall extending axially from an inner periphery of the annular plate into the central hole of the support base, and a pair of spring driving elements projecting from an outer periphery of the annular plate and aligned radially and respectively with said spring-retaining lugs. The torsion spring is disposed around the inner annular flange and between the first annular section and the annular plate, and has a pair of spring legs each abutting against one of the spring-retaining lugs and one of the spring driving elements.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
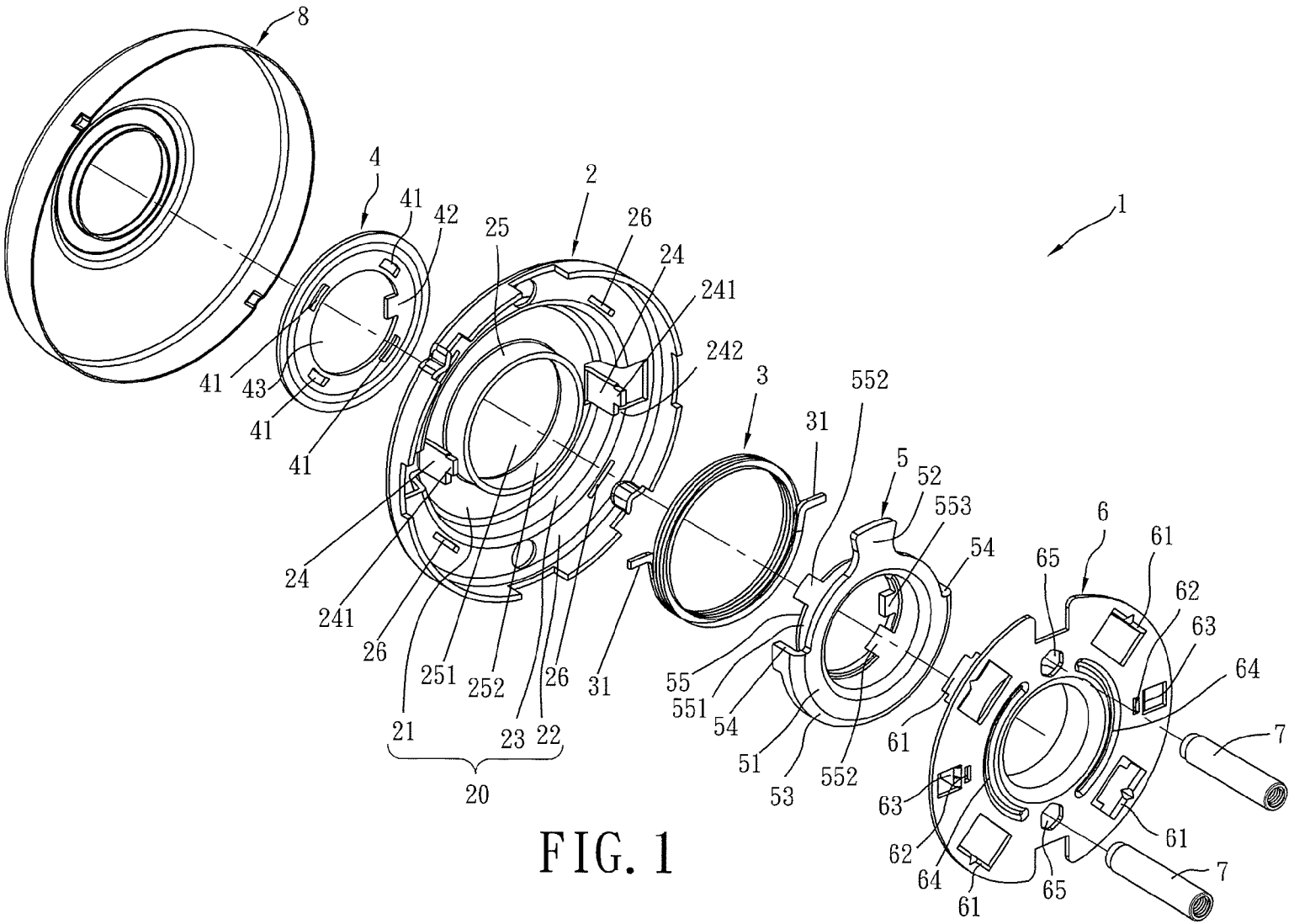
FIG. 1 is an exploded view of a preferred embodiment of a handle-returning device for a cylinder lock assembly according to the present invention.
Figure 3:
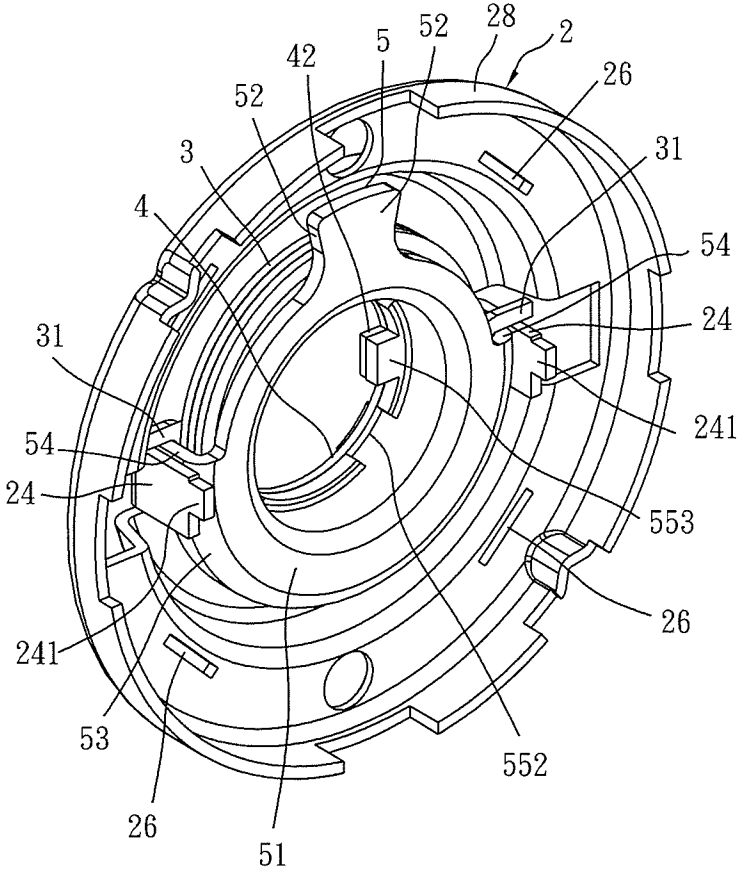
FIG. 3 is a perspective view illustrating the rotation driver, a support base and a torsion spring of the preferred embodiment.
Figure 2:
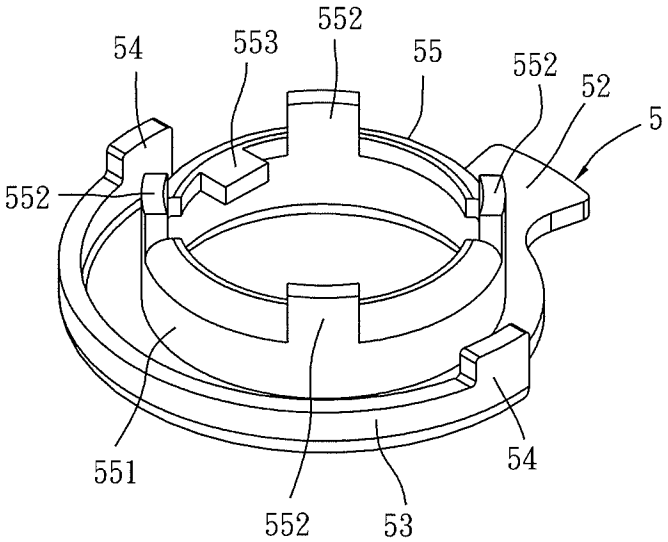
FIG. 2 is a perspective view of a rotation driver of the preferred embodiment.

Referring to FIGS. 1 to 10, a handle-returning device 1 for returning a handle of a cylinder lock assembly according to a preferred embodiment of the present invention includes a support base 2, a torsion spring 3, a rotary plate 4, a rotation driver 5, and a cover plate 6.

The support base 2 includes an annular base wall 20, an inner annular flange 25 projecting axially from an inner periphery of the annular base wall 20 and defining a central hole 251, an outer annular flange 28 projecting axially from an outer periphery of the annular base wall 20. The annular base wall 20 is stepped and has a first annular section 21 connected to the inner annular flange 25, a second annular section 22 connected to the outer annular flange 28, a third annular section 23 connected between and extending transversely of the first and second annular sections 21, 22, a pair of annularly spaced apart spring-retaining lugs 24 projecting axially from the first annular section 21 proximate to the third annular section 23, and four annularly spaced apart interlocking holes 26 formed in the second annular section 22 at equal intervals. Each of the spring-retaining lugs 24 has a stepped fixing end 241 with a shoulder 242.

The rotation driver 5 is rotatable through an operation of a lever handle (not shown), and includes an annular plate 51 facing the first annular section 21 of the annular base wall 20, a stop part 52 projecting radially and outwardly from an outer periphery of the annular plate 51, an arcuate wall 53 projecting axially from and extending circumferentially of the outer periphery of the annular plate 51, and two spring driving elements 54 extending axially from the outer periphery of the annular plate 51 toward the first annular section 21 of the annular base wall and interconnected by the arcuate wall 53. The stop part 52 is formed between the two spring driving elements 54. The spring driving elements 54 are aligned radially and respectively with the spring-retaining lugs 24 of the support base 2.

The rotation driver 5 further includes an inner tubular wall 55 extending axially from an inner periphery of the annular plate 51 into the central hole 251 of the support base 2. An outer surface 551 of the inner tubular wall 55 abuts against an inner surface 252 of the inner annular flange 25 (see FIG. 8). Four annularly spaced apart tongues 552 project axially from the inner tubular wall 55 and extending through the central hole 251 of the support base 2. A finger plate 553 projects radially and inwardly from the inner tubular wall 55 for engaging a tubular spindle (not shown), which will be inserted into the rotation driver 5 when assembled with the rotation driver.

The torsion spring 3 is disposed around the inner annular flange 25 of the support base 2 and between the first annular section 21 of the support base 2 and the annular plate 51 of the rotation driver 5. The torsion spring 3 has two spring legs 31 each abutting against one of the spring-retaining lugs 24 and one of the spring driving elements 54.

The rotary plate 4 is disposed in abutment with an outer surface of the annular base wall 20 of the support base 2 opposite to the annular plate 51. The rotary plate 4 has a central hole 43 aligned with the central hole 251 of the support base 2, four annularly spaced apart engaging holes 41 formed around the central hole 43 to respectively engage the ends of the tongues 552 of the rotation driver 5, which extend out of the central hole 251 of the support base 2, and a finger plate 42 projecting radially into the central hole 43 from an inner periphery of the rotary plate 4. The finger plate 42 is aligned axially with and disposed in proximity to the finger plate 553 of the rotation driver 5.

The cover plate 6 covers an inner surface of the annular plate 51 of the rotation driver 5 opposite to the annular base wall 20. The cover plate 6 has four annularly spaced apart interlocking tabs 61 axially projecting from the cover plate 6 to the second annular section 22 of the support base 2, two annularly spaced apart fixing slots 62, two annularly spaced apart guard plates 63 projecting axially toward the third annular section 23 of the annular base wall 20 from the cover plate 6 in proximity to the fixing slots 62, and two annularly spaced apart ribs 64, and two annularly spaced apart mounting holes 65. Ends of the interlocking tabs 61 in the cover plate 6 are engaged in the interlocking holes 26 in the second annular section 22, respectively. The stepped fixing ends 241 of the spring-retaining lugs 24 extend beyond the rotation driver 5 and are engaged in the fixing slots 62, respectively. The guard plates 63 are aligned respectively and radially with the spring-retaining lugs 24. The ribs 64 are disposed in abutment with the annular plate 51 of the rotation driver 5.

For assembly, the torsion spring 3 is disposed around the inner annular flange 25 of the support base 2 and between the first annular section 21 of the annular base wall 20 and the annular plate 51 of the rotation driver 5. The cover plate 6 is disposed over the rotation driver 5 and is engaged with the support base 2. After assembly, the support base 2 is covered by a rose disc 8.

Figure 6:
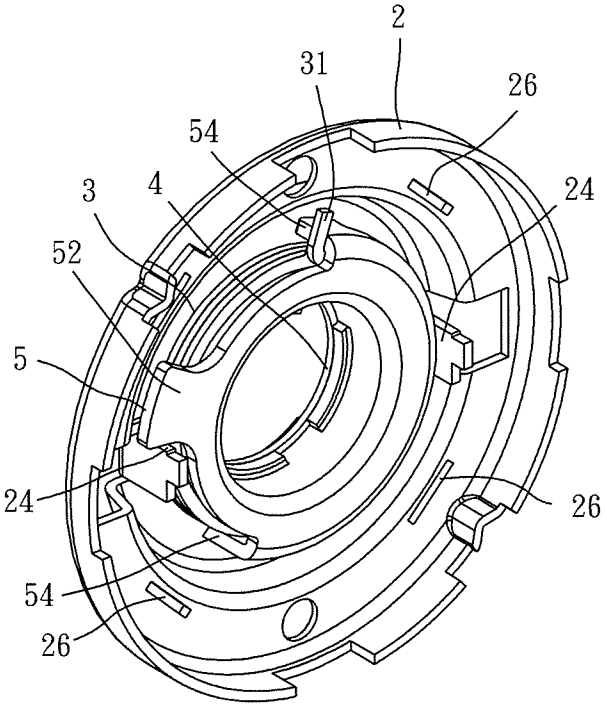
FIG. 6 is a perspective view illustrating that the rotation driver is rotated counterclockwise relative to the support base.
Figure 8:
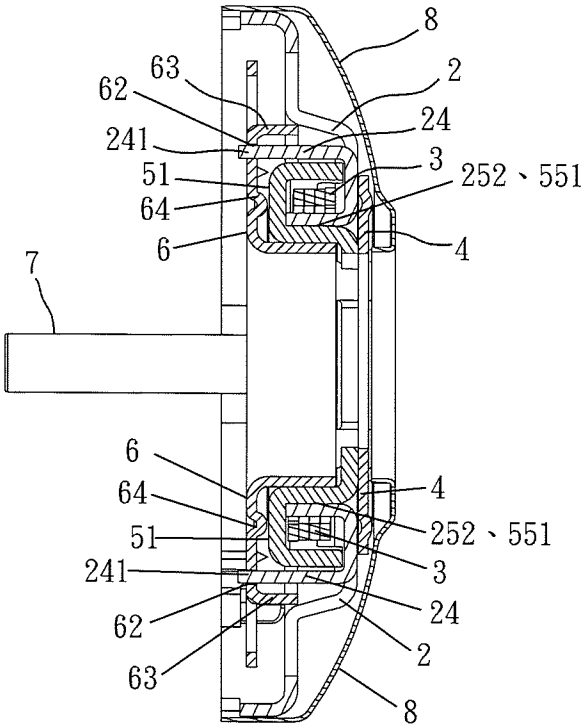
FIG. 8 is a sectional view taken along line 8-8 of FIG. 7.
Figure 7:
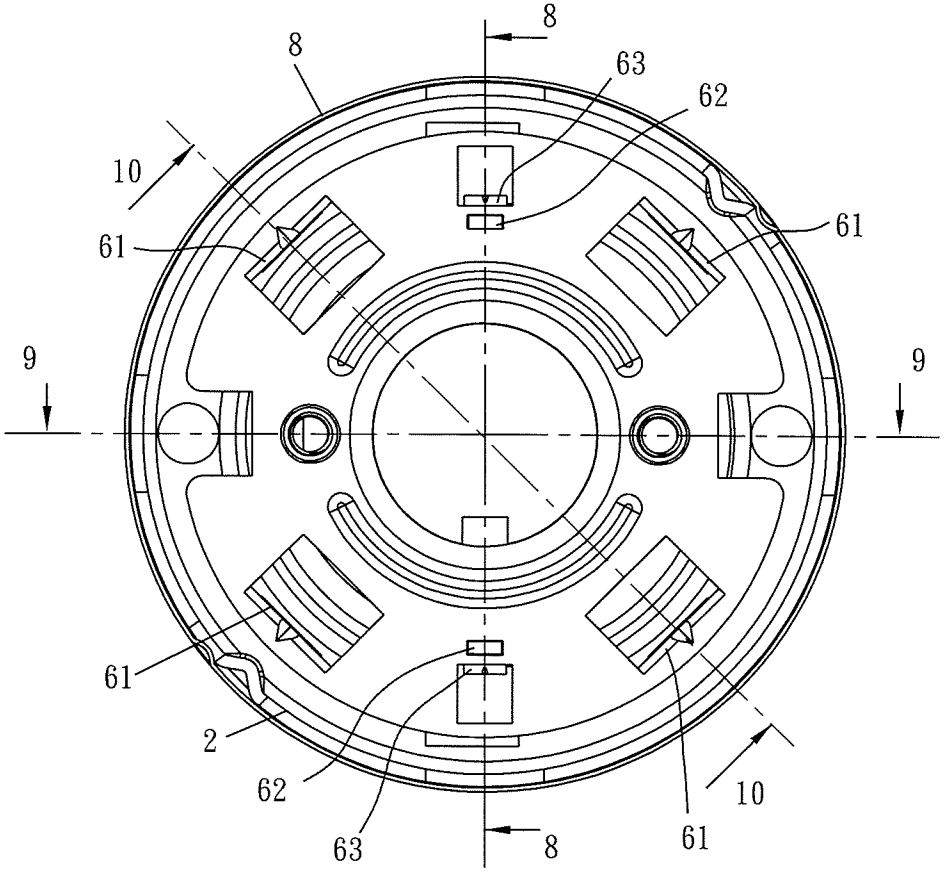
FIG. 7 is an elevation view of the preferred embodiment.
Figure 10:
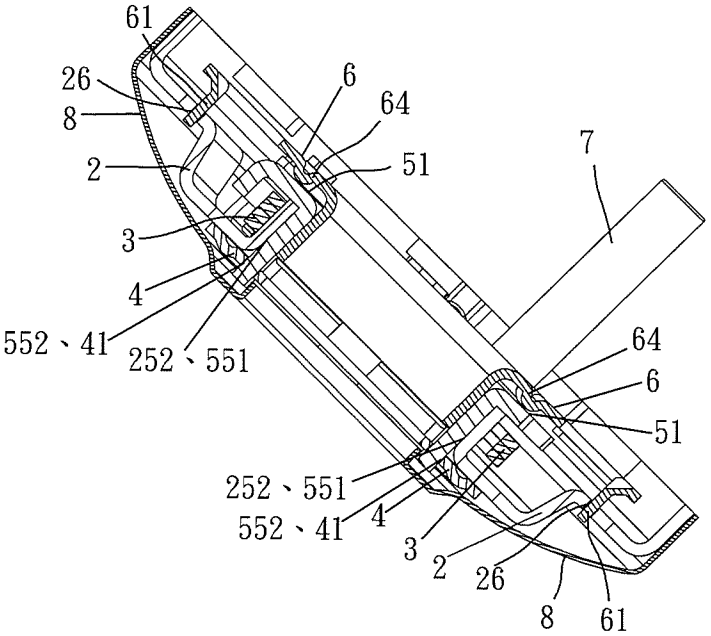
FIG. 10 is a sectional view taken along line 10-10 of FIG. 7.
Figure 9:
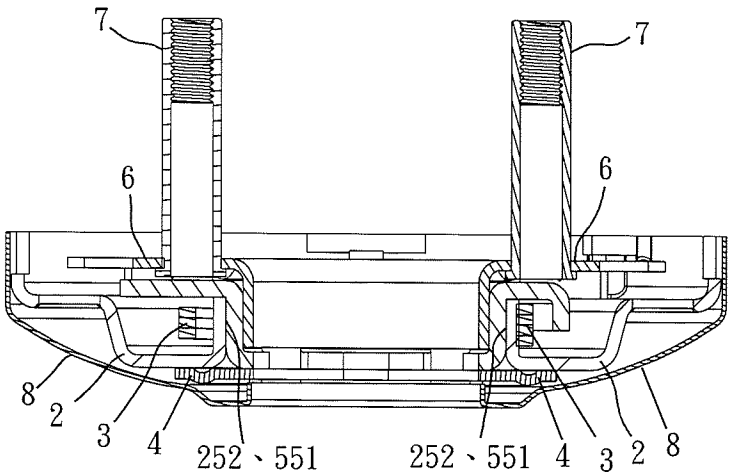
FIG. 9 is a sectional view taken along line 9-9 of FIG. 7.

In use, the handle-returning device 1 may be assembled with a lever handle (not shown) and a tubular spindle (not shown), which can rotate the rotation driver 5 when the lever handle is turned clockwise or counter-clockwise. Before the lever handle is turned, each of the two spring legs 31 of the torsion spring 3 abuts against one of the spring-retaining lugs 24 and one of the spring driving members 54. Referring to FIG. 6, when the rotation driver 5 is rotated counter-clockwise relative to the support base 2, one of the spring driving members 54 pushes one of the spring legs 31 away from one of the spring-retaining lugs 24 until the stop part 52 contacts against the other one of the spring-retaining lugs 24. Accordingly the torsion spring 3 is stressed. When the lever handle is released, the torsion spring 3 exerts a returning force onto the rotation driver 5, thereby returning the lever handle to its original position.

Because the guard plates 63 are aligned respectively and radially with the spring-retaining lugs 24, the guard plates 63 can reinforce the spring-retaining lugs 24 to oppose a hitting force exerted by the stop part 52 of the rotation driver 5 when the rotation driver 5 is rotated. In addition, since the ribs 64 are disposed in abutment with the annular plate 51 of the rotation driver 5, the rotation driver 5 can be stabilized. Moreover, with the provision of the finger plate 42 in the rotary plate 4, which is aligned axially with and abuts against the finger plate 553 of the rotation driver 5, the finger plate 553 can be reinforced.

Figure 5:
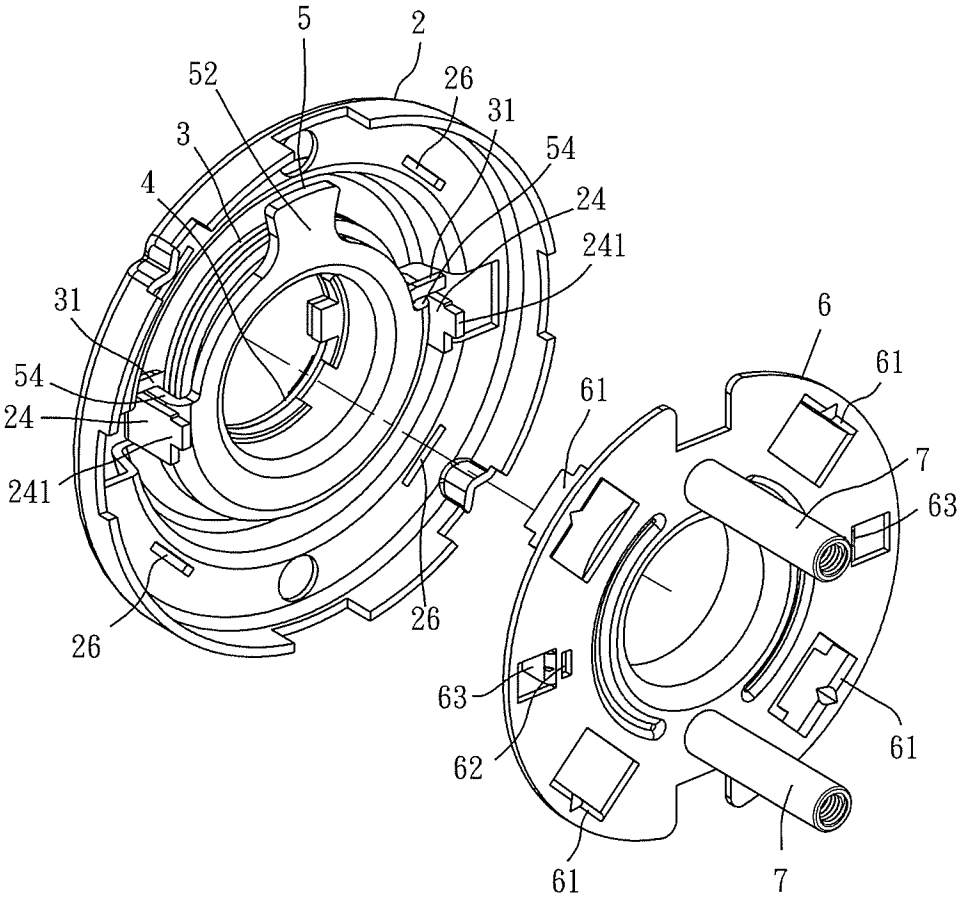
FIG. 5 is a perspective view illustrating that a cover plate is separated from the remaining components of the assembly of the preferred embodiment.
Figure 4:
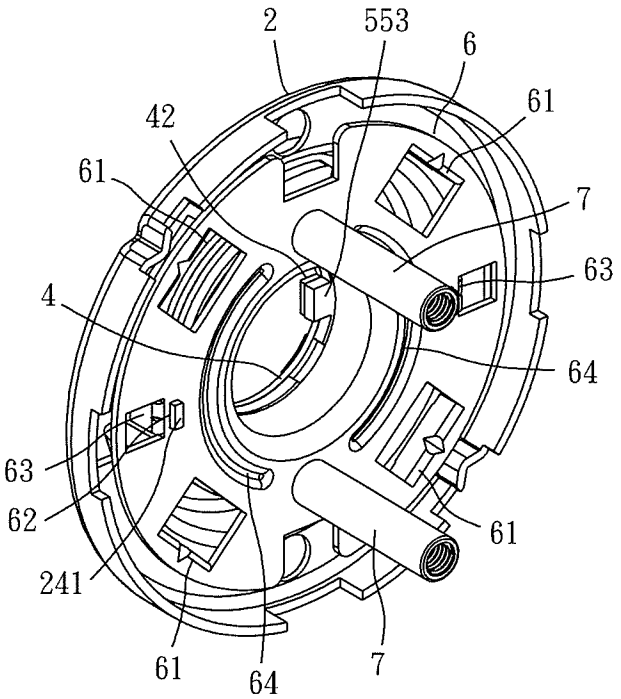
FIG. 4 is a perspective view of the preferred embodiment of FIG. 1 in an assembled state.

The handle-returning device 1 may be installed on an inner side of a cylinder lock assembly. For installation, a pair of female screw members 7 may be respectively assembled to the mounting holes 65 in the cover plate 6 as shown in FIGS. 1 and 5.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A handle-returning device adapted to return a handle of a cylinder lock assembly after the handle is rotated, comprising:

a support base having an annular base wall, an inner annular flange projecting axially from an inner periphery of said annular base wall and defining a central hole, and at least one spring-retaining lug projecting axially from said annular base wall;

a rotation driver including an annular plate spaced axially from said annular base wall, an inner tubular wall extending axially from an inner periphery of said annular plate into said central hole of said support base, at least one spring driving element formed on said annular plate and aligned radially with said at least one spring-retaining lug, and at least one tongue projecting axially from said inner tubular wall and extending through said central hole of said support base;

a torsion spring disposed around said inner annular flange and between said annular base wall and said annular plate, and having at least one spring leg abutting against said at least one spring-retaining lug and said at least one spring driving element; and a rotary plate disposed in abutment with a surface of said annular base will of said support base opposite to said annular plate, and having at least one engaging part proximate to said central hole of said support base to engage said at least one tongue of said rotation driver, wherein said at least one engaging part is in the form of at least one engaging hole formed in said rotary plate to engage an end of said at least one tongue, and wherein said rotary plate further has a central hole aligned with said central hole of said support base, and a finger plate projecting radially and inwardly from an inner periphery of said rotary plate, said rotation driver further having a finger plate projecting radially from said inner tubular wall and aligned axially with said finger plate of said rotary plate.

2. A handle-returning device adapted to return a handle of a cylinder lock assembly after the handle is rotated, comprising:

a support base having an annular base wall, an inner annular flange projecting axially from an inner periphery of said annular base wall and defining a central hole, and at least one spring-retaining lug projecting axially from said annular base wall;

a rotation driver including an annular plate spaced axially from said annular base wall, an inner tubular wall extending axially from an inner periphery of said annular plate into said central hole of said support base, at least one spring driving element formed on said annular plate and aligned radially with said at least one spring-retaining lug, and at least one tongue projecting axially from said inner tubular wall and extending through said central hole of said support base;

a torsion spring disposed around said inner annular flange and between said annular base wall and said annular plate, and having at least one spring leg abutting against said at least one spring-retaining lug and said at least one spring driving element;

a rotary plate disposed in abutment with a surface of said annular base wall of said support base opposite to said annular plate, and having at least one engaging part proximate to said central hole of said support base to engage said at least one tongue of said rotation driver; and a cover plate covering a surface of said annular plate of said rotation driver opposite to said annular base wall and having at least one interlocking part engaging said support base;

wherein said at least one interlocking part of said cover plate is configured as at least one interlocking tab axially projecting from said cover plate to said annular base wall of said support base, said annular base wall having at least one interlocking hole formed therein to engage an end of said at least one interlocking tab.

3. The handle-returning device of claim 2, wherein said cover plate further has at least one mounting hole adapted to mount at least one tubular female screw member.

4. The handle returning device of claim 2, wherein said cover plate further has at least one fixing slot, said at least one spring retaining lug of said support base having a fixing end extending, into said at least one fixing slot.

5. The handle-returning device of claim 2, wherein said cover plate further has at least one guard plate projecting axially to said annular base wall of said support base and aligned radially with said at least one spring-retaining lug.

6. A handle-returning device adapted to return a handle of a cylinder lock assembly after the handle is rotated, comprising:

a support base having an annular base wall, an inner annular flange projecting axially from an inner periphery of said annular base wall and defining a central hole, and at least one spring-retaining lug projecting axially from said annular base wall;

a rotation driver including an annular plate spaced axially from said annular base wall, an inner tubular wall extending axially from an inner periphery of said annular plate into said central hole of said support base, at least one spring driving element formed on said annular plate and aligned radially with said at least one spring-retaining lug, and at least one tongue projecting axially from said inner tubular wall and extending through said central hole of said support base;

a torsion spring disposed around said inner annular flange and between said annular base wall and said annular plate and having at least one spring leg abutting against said at least one spring-retaining lug and said at least one spring driving element;

a rotary plate disposed in abutment with a surface of said annular base wall of said support base opposite to said annular plate, and having at least one engaging part proximate to said central hole of said support base to engage said at least one tongue of said rotation driver; and a cover plate covering a surface of said annular plate of said rotation driver opposite to said annular base wall and having at least one interlocking part engaging said support base;

wherein said at least one spring-retaining lug comprises a pair of annularly spaced apart spring-retaining lugs, said at least one spring driving element comprises a pair of spring driving elements, wherein one of said spring driving elements is radially aligned with one of said spring-retaining lugs, said rotation driver further having a stop pan disposed between said spring-retaining lugs and rotatable to contact one of said spring-retaining lugs when said rotation driver is rotated by a predetermined angle, said stop part extending radially and outwardly from said annular plate of said rotation driver.

7. A handle-returning device adapted to return a handle of a cylinder lock assembly after the handle is rotated, coin rising;

a support base having an annular base wall, an inner annular flange projecting axially from an inner periphery of said annular base wall and defining a central hole, and at least one spring-retaining lug projecting axially from said annular base wall;

a rotation driver including an annular plate spaced axially from said annular base wall, an inner tubular wall extending axially from an inner periphery of said annular plate into said central hole of said support base, at least one spring driving element formed on said annular plate and aligned radially with said at least one spring-retaining lug, and at least one tongue projecting axially from said inner tubular wall and extending through said central hole of said support base;

a torsion spring disposed around said inner annular flange and between said annular base wall and said annular plate, and having at least one spring leg abutting, against said at least one spring-retaining lug and said at least one spring driving element;

a rotary plate disposed in abutment with a surface of said annular base wall of said support base opposite to said annular plate, and having at least one engaging part proximate to said central hole of said support base to engage said at least one tongue of said rotation driver; and a cover plate covering a surface of said annular plate of said rotation driver opposite to said annular base wall and having at least one interlocking part engaging said support base;

wherein said cover plate further has at least one rib projecting axially therefrom to contact said annular plate of said rotation driver.

8. A handle-returning device adapted to return a handle of a cylinder lock assembly after the handle is rotated, comprising:

a support base having an annular base wall, an inner annular flange projecting axially from an inner periphery of said annular base wall and defining a central hole, an outer annular flange projecting axially from an outer periphery of said annular base wall, said annular base wall being stepped and having a first annular section connected to said inner annular flange, a second annular section connected to said outer annular flange, a third annular section interconnecting and extending transversely of said first and second annular sections a pair of annularly spaced apart spring-retaining lugs projecting axially from said first annular section;

a rotation driver adapted to be rotated through an operation of the handle, and including an annular plate, an inner tubular wall extending axially from an inner periphery of said annular plate into said central hole of said support base, and a pair of spring driving elements projecting from an outer periphery of said annular plate and aligned radially with said spring-retaining lugs, respectively; and a torsion spring disposed around said inner annular flange and between said first annular section and said annular plate, and having a pair of spring legs, each abutting against a respective one of said spring-retaining lugs and a respective one of said spring driving elements; and a cover plate covering a surface of said annular plate of said rotation driver opposite to said annular base wall, and having at least one interlocking tab axially projecting therefrom to said second annular section of said annular base wall, said second annular section having at least one interlocking hole formed therein to engage an end of said at least one interlocking tab.

9. The handle-returning device of claim 8, wherein said cover plate further has a pair of fixing slots, each of said spring-retaining lugs having a fixing end extending into a respective one of said fixing slots.

10. The handle-returning device of claim 9, wherein said cover plate further has of guard plates projecting axially to said third annular section of said annular base wall and aligned radially with said spring-retaining lug, respectively.

* * * * *